US007905636B2

(12) United States Patent
Kosters

(10) Patent No.: US 7,905,636 B2
(45) Date of Patent: Mar. 15, 2011

(54) LUMINAIRE AND LAMELLAE LOUVER

(75) Inventor: Paulus Gerardus Henricus Kosters, Delden (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 228 days.

(21) Appl. No.: 12/282,161

(22) PCT Filed: Feb. 27, 2007

(86) PCT No.: PCT/IB2007/050629

§ 371 (c)(1), (2), (4) Date: Sep. 8, 2008

(87) PCT Pub. No.: WO2007/102101

PCT Pub. Date: Sep. 13, 2007

(65) Prior Publication Data

US 2009/0052169 A1 Feb. 26, 2009

(30) Foreign Application Priority Data

Mar. 8, 2006 (EP) ..... 06110840

(51) Int. Cl.
*F21V 11/02* (2006.01)

(52) U.S. Cl. ..... 362/342; 362/217.01; 362/217.02; 362/217.03

(58) Field of Classification Search ..... 362/217.01–217.03, 270.01
See application file for complete search history.

(56) References Cited

U.S. PATENT DOCUMENTS

| | | | | |
|---|---|---|---|---|
| 2,221,954 | A | | 11/1940 | Schepmoes |
| 2,429,141 | A | * | 10/1947 | Taylor ..... 362/217.03 |
| 2,837,632 | A | * | 6/1958 | Lipscomb ..... 362/342 |
| 3,135,472 | A | | 6/1964 | Helmholz |
| 3,628,007 | A | * | 12/1971 | Rosenberg ..... 362/342 |
| 4,516,197 | A | * | 5/1985 | Yonkers ..... 362/342 |
| 5,493,826 | A | * | 2/1996 | Keller et al. ..... 52/204.59 |

FOREIGN PATENT DOCUMENTS

| | | |
|---|---|---|
| DE | 29913663 | 11/1999 |
| FR | 1013003 | 7/1952 |
| FR | 2862124 | 5/2005 |
| GB | 753295 | 7/1956 |
| WO | 96/25623 | 8/1996 |
| WO | 2005/098309 | 10/2005 |
| WO | 2005/108862 | 11/2005 |

* cited by examiner

*Primary Examiner* — Anabel M Ton

(57) ABSTRACT

The luminaire and the lamellae louver (20) have lamellae (10) which enclose an acute angle δ with a main plane S. The lamellae (10) may have a kink (13) in plane S, and additional kinks (14) laterally of the plane S. The lamellae (10) prevent glare in plane S and in surrounding planes and thereby allow the luminaire to meet the Unified Glare Rating.

10 Claims, 6 Drawing Sheets

LUMINAIRE AND LAMELLAE LOUVER

The invention relates to a luminaire comprising:

a main plane S;

means for accommodating at least one elongate electric lamp parallel to or in the main plane S;

a respective side reflector at either side of the main plane S, each of said side reflectors having a respective rim;

an elongate light emission window between the rims, transverse to the main plane S;

a plurality of substantially equidistant lamellae, extending from one side reflector to the other, adjacent the light emission window, which lamellae have an inner face facing away from the light emission window and side faces extending therefrom to meet one another adjacent the light emission window.

The invention also relates to an elongate lamellae louver comprising a plurality of substantially equidistant lamellae intersecting a longitudinal main plane S, which lamellae have an inner face and side faces extending therefrom so as to meet one another.

An embodiment of such a luminaire is known from WO 96/25623.

The side reflectors serve to shape light emitted by an accommodated lamp in lateral directions into a beam, and also to create a cut-off angle with respect to the plane of the light emission window. No light is emitted beside the luminaire within that cut-off angle.

The purpose of the lamellae is to create a similar cut-off angle in the main plane S and in planes which enclose a small angle with plane S. In order to prevent light rays from bouncing repeatedly between two neighboring lamellae before leaving the luminaire, the lamellae have triangular cross sections. The light rays are thus reflected by a lamella at an angle to the light emission window wider than their angle of incidence with respect to that window.

In the known luminaire, the screening of light by the lamellae is optimized in that an over-screening, which would occur with lamellae having a straight contour in the light emission window, is counteracted by the lamellae having a convex contour.

There is a trend towards relatively narrow luminaries having a width of the light emission window, i.e. a distance between the rims of the side reflectors, which is generally in the range of 5 to 9 cm, e.g. 7 cm.

At present luminaries have to comply with a Unified Glare Rating (UGR), which is measured in a standardized room. The UGR imposes limitations on the amount of glare an operated luminaire may cause. Limitations are set to glare transverse to the plane S and glare in longitudinal direction, i.e. in plane S.

It was found that narrow known luminaries, when complying with UGR in transverse direction, may fail to comply therewith in longitudinal direction.

It is a first object of the invention to provide a luminaire of the kind described in the opening paragraph which complies with UGR also in longitudinal direction, even if the luminaire has a narrow light emission window.

It is a second object of the invention to provide an elongate lamellae louver of the kind described in the opening paragraph which allows a luminaire, when the louver is mounted therein, to comply with UGR also in longitudinal direction, even if the luminaire has a narrow light emission window.

The first object is achieved in that the lamellae enclose an acute angle δ with the main plane S.

The invention is based on the recognition that light emitted in directions transverse to the main plane S is for the major portion shaped into a beam by the side reflectors, which are relatively large compared with the lamellae. The side reflectors may even extend up to the major plane S, if so desired, or even together constitute one integral reflector. Light emitted in longitudinal directions by contrast leaves the luminaire for a large portion without prior reflection. This has the effect that, when the luminaire is designed to be critical with respect to UGR, it will comply with UGR in transverse directions, but not in longitudinal directions. Imperfections in the manufacture and pollution of the lamellae may add to this. The oblique direction of the lamellae throws light reflected by them into a more transverse direction. As a result the UGR in longitudinal direction comes within the norm.

The reflecting and beam-shaping surface of the lamellae may be enlarged in that their size transverse to the light emission window is increased, but this would considerably increase the material content of the lamellae because of their triangular cross-section, and thus also the cost price of the luminaire.

Generally, the acute angle δ is in the range of 65° to 85°. When angle δ is smaller than 65°, generally too much light is reflected laterally by the lamellae at the expense of radiation in longitudinal directions. When angle δ is larger than 85°, generally an insufficient effect is obtained. More particularly, the angle δ is in the range of 65° to 80°.

It is noted that it is the side reflectors that generally achieve the screening-off and the creation of the cut-off angle within angles δ. As a result, the oblique elongate openings between lamellae have no or hardly any disadvantageous effect in this respect.

In an embodiment, the lamellae have a kink in the main plane S and extend at each side of plane S at an angle δ. The angles are of opposite signs then. The lamellae together create a fish-bone pattern.

This embodiment has the advantage that the light emission window with the lamellae has a more symmetrical appearance. It also has the advantage that the lamellae with each of their side faces deflect light reflected by them to both sides of the main plane S. However, such a kink may alternatively be present laterally of the main plane S.

In a modification, the lamellae each have at least one additional kink at each side of main plane S. The lamellae extend at either side of the additional kinks at angle δ to the main plane S in that case, but the angles have opposite signs. It is an advantage of this modification that the light emission window with the lamellae has a more homogeneous appearance. It is a result of the at least one additional kink that the portion of each lamella that extends parallel to the main plane S is smaller.

Advantageously, the number of additional kinks and the distance between neighboring kinks is such that the portion of each lamella that extends parallel to the main plane S corresponds at most to the mutual distance of the lamellae. In this case the light emission window can easily be homogeneously filled with lamellae.

In this respect the following is remarked. The lamellae may be united so as to form a louver. In this case the lamellae are straight, or have a single kink, e.g. in the main plane S, and not all of the lamellae may run all the way from one side reflector to the other: i.e. not all of them are "complete". At the narrow ends of the light emission window some lamellae run from a side reflector to an end of the light emission window, or in the case of lamellae having a single kink in the main plane S, from an end via the main plane S to the same end. Incomplete lamellae may be mechanically held by an end strip of the louver. From an optical point of view, however, it generally does not matter if incomplete lamellae are absent. Triangular open spaces are then present at the narrow ends of the light emission window.

The luminaire of the invention will generally hold a tubular low-pressure mercury fluorescent lamp. Such a lamp has at both of its ends a base with one or more contacts, generally pins. Respective electrodes are present in the end portions of the lamp. No light is generated between the electrode and the base, in the so-called electrode chamber, and the base and its contact(s) obviously do not generate light either. So the length needed to accommodate the lamp is greater than the length over which light is generated during lamp operation. As a result, triangular open spaces have little or no optical effect.

The lamellae may be of metal, but in view of their cost price they generally are of relatively high-melting synthetic resin such as, for example, polycarbonate (PC), polycarbonate-.acrylonitrilbutadienestyrene (PC.ABS), polystyrene (PS). The resin generally is metal-coated, e.g. with aluminum, to have a relatively high reflectivity. The surfaces of the lamellae may be specularly or semi-specularly mirroring. The same applies to a louver composed of the lamellae.

The inner face of the lamellae may be non-mirroring in that it is kept free from a coating. In a favorable embodiment, however, the inner face has a structured surface and a metal coating between the side faces. A structured surface of the inner face, a sawtooth-like structure, is well known in the art to avoid light rays from being reflected to the side reflectors and subsequently sideways into the cut-off angle of the luminaire.

The lamellae, whether or not united so as to constitute a louver, may be permanently attached to the side reflectors or be separably connected thereto, e.g. by means of protrusions snapped into recesses or openings e.g. in the side reflectors.

It is noted that FR-1,013,003 discloses a luminaire which has a louver in the light emission window. The louver, however, has no parallel lamellae, but is built up from flat strips, each of which is connected to its neighboring strips so as to form rhombic openings. The major diagonals of the openings are in the main plane and in planes parallel thereto. The shielding by this louver is based on the major diagonals. As a result, it shields much too strongly in all other directions.

The luminaire may comprise a housing accommodating the means, the side reflectors and the lamellae. An e.g. lacquered wall of the housing opposite the light emission window may also constitute a reflector. The luminaire may, however, have a second window opposite the light emission window in order to provide also indirect lighting.

The luminaire, mounted against, in, or below a ceiling, may be used for illuminating e.g. offices and shops.

The second object of the invention is achieved in that the lamellae enclose an acute angle δ with the main plane S.

Embodiment of the luminaire and the lamellae louver according to the invention are shown in and explained with reference to the drawings.

Figure 1:
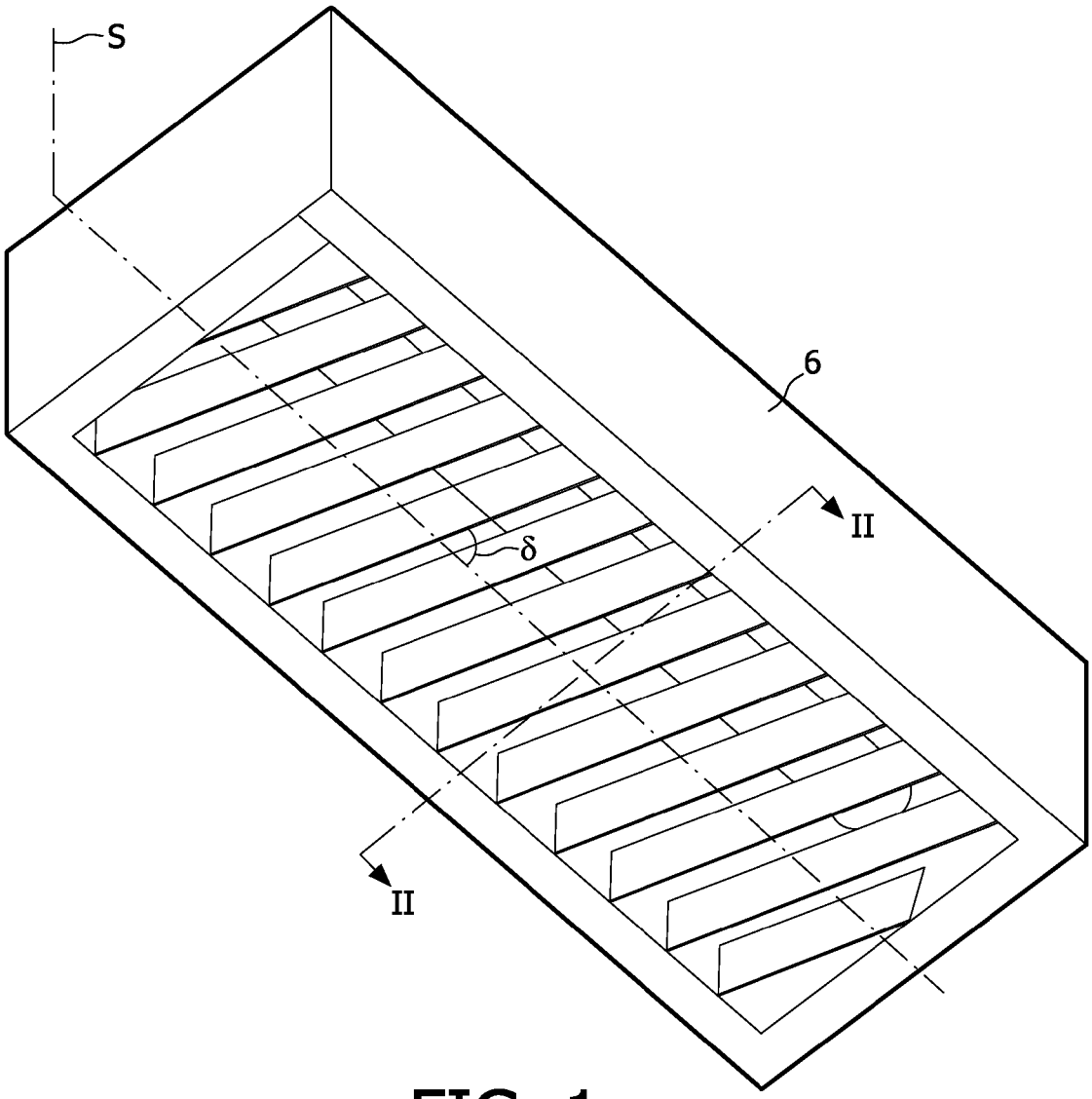
FIG. 1 represents a perspective view of an embodiment of the luminaire.
Figure 2:
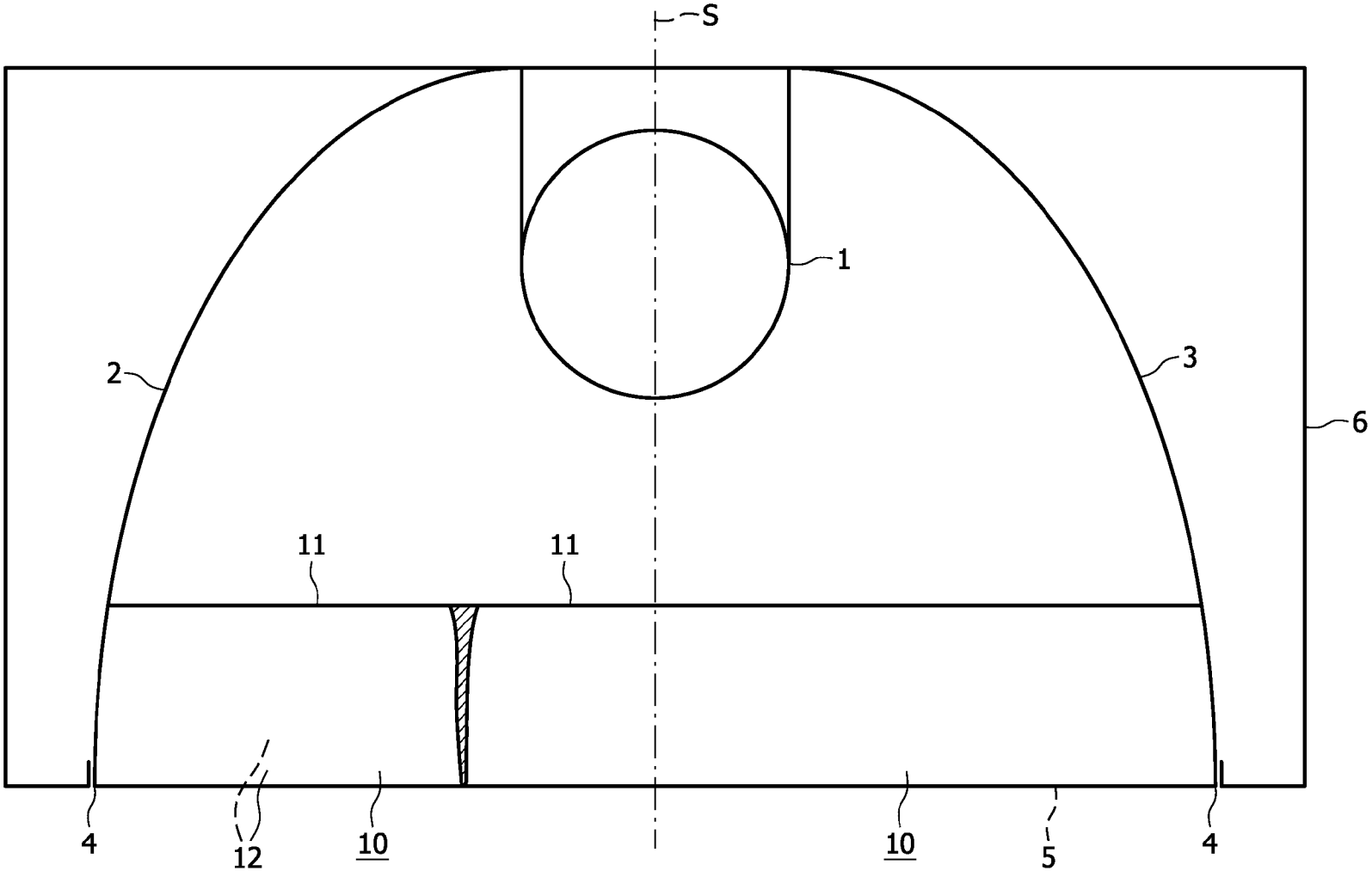
FIG. 2 is a cross-section of the luminaire taken on the line II-II in FIG. 1.

In FIGS. 1 and 2, the luminaire has a main plane S and means 1 for accommodating an elongate electric lamp parallel to the main plane S. In FIGS. 1 and 2, the means 1 are positioned for mounting a lamp with its longitudinal axis in plane S. A respective side reflector 2, 3 is present at either side of the main plane S, which side reflectors 2, 3 each have a rim 4. An elongate light emission window 5 extends between the rims 4, transverse to the main plane S. The width of the light emission window in the Figs. is 7 cm. A plurality of substantially equidistant lamellae 10 extending from one side reflector 2 to the other 3 is present adjacent the light emission window 5. The lamellae 10 each have an inner face 11 facing away from the light emission window 5, which is better observable in other Figs., and side faces 12, better observable in FIG. 3, extending therefrom so as to meet one another adjacent the light emission window 5. They are made from PC and aluminized. The side faces 12 are parabolically concave in shape transverse to the light emission window 5. The side reflectors 2, 3 are also concave transverse to the light emission window 5. They consist of semi-specularly reflecting aluminum, but in other embodiments of e.g. specularly reflecting aluminum. The luminaire is accommodated in a housing 6.

The lamellae 10 extend at an acute angle δ to the main plane S.

The luminaire is suitable for accommodating an electric fluorescent lamp having a diameter of 16 mm or less and consuming a power of 36 W. The luminaire complies with UGR both in longitudinal and in transverse direction of the lamp, having in each of these directions UGR 19, which is the norm for use in offices. The norm for use in shops is in the range of 22 to 25.

An identical luminaire except for the fact that its lamellae extend in the traditional manner, perpendicularly to the side reflectors, has UGR 18 transversely to the side reflectors and UGR 23 in plane S. It is thus seen that the UGR value in plane S is lowered so as to arrive within the norm at the expense of the UGR in transverse direction in the luminaire of the invention, but the latter value still remains within the norm.

In the Fig., the acute angle δ is 72°, i.e. within the range of 65° to 85°.

Figure 3:
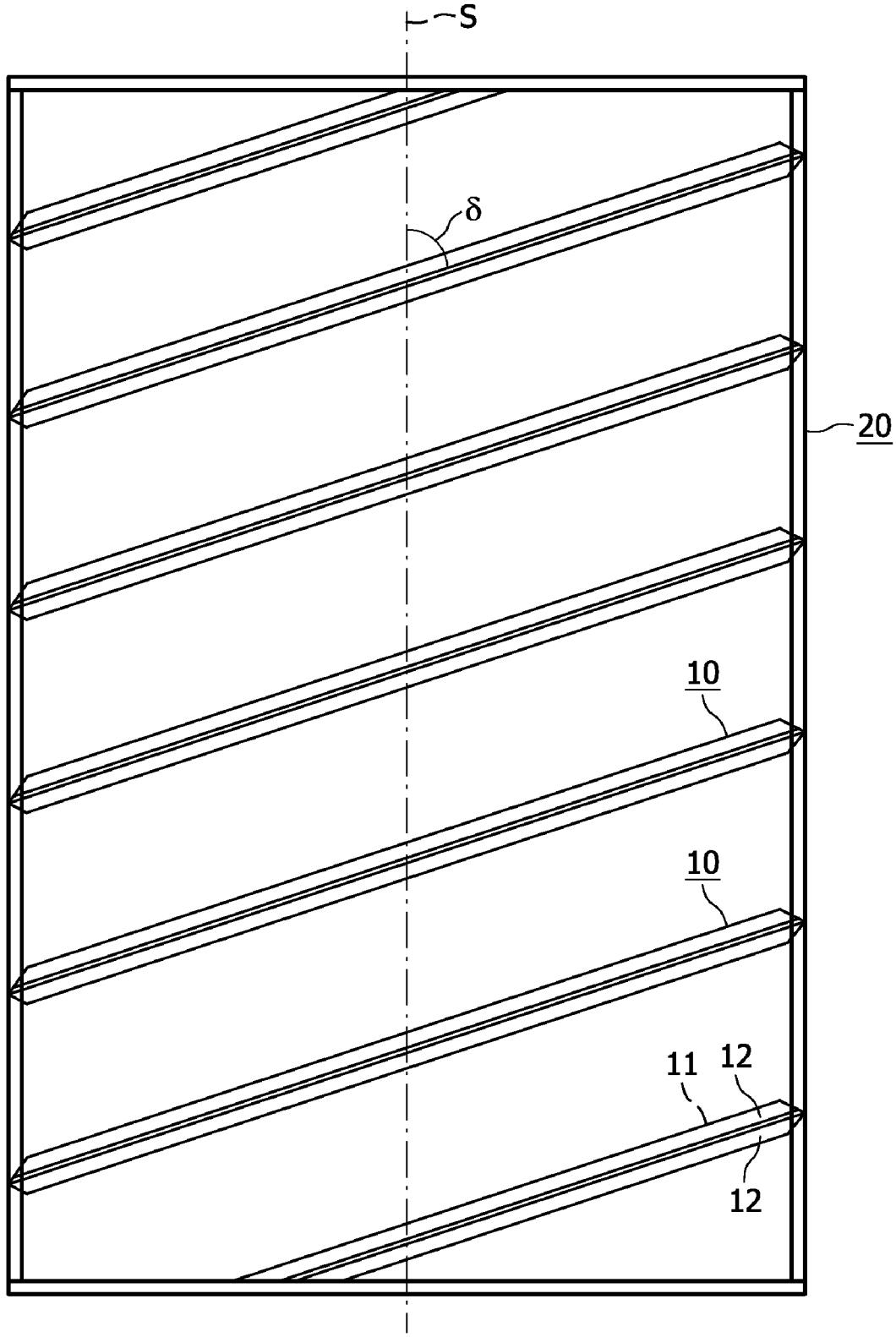
FIG. 3 is a plan view of an embodiment of a lamellae louver.

In FIG. 3, the elongate lamellae louver 20 shown is suitable for use in the luminaire of FIGS. 1 and 2. The lamellae 10 are identical to the lamellae 10 of the preceding and of the following Figs. in cross-section.

Figure 4:
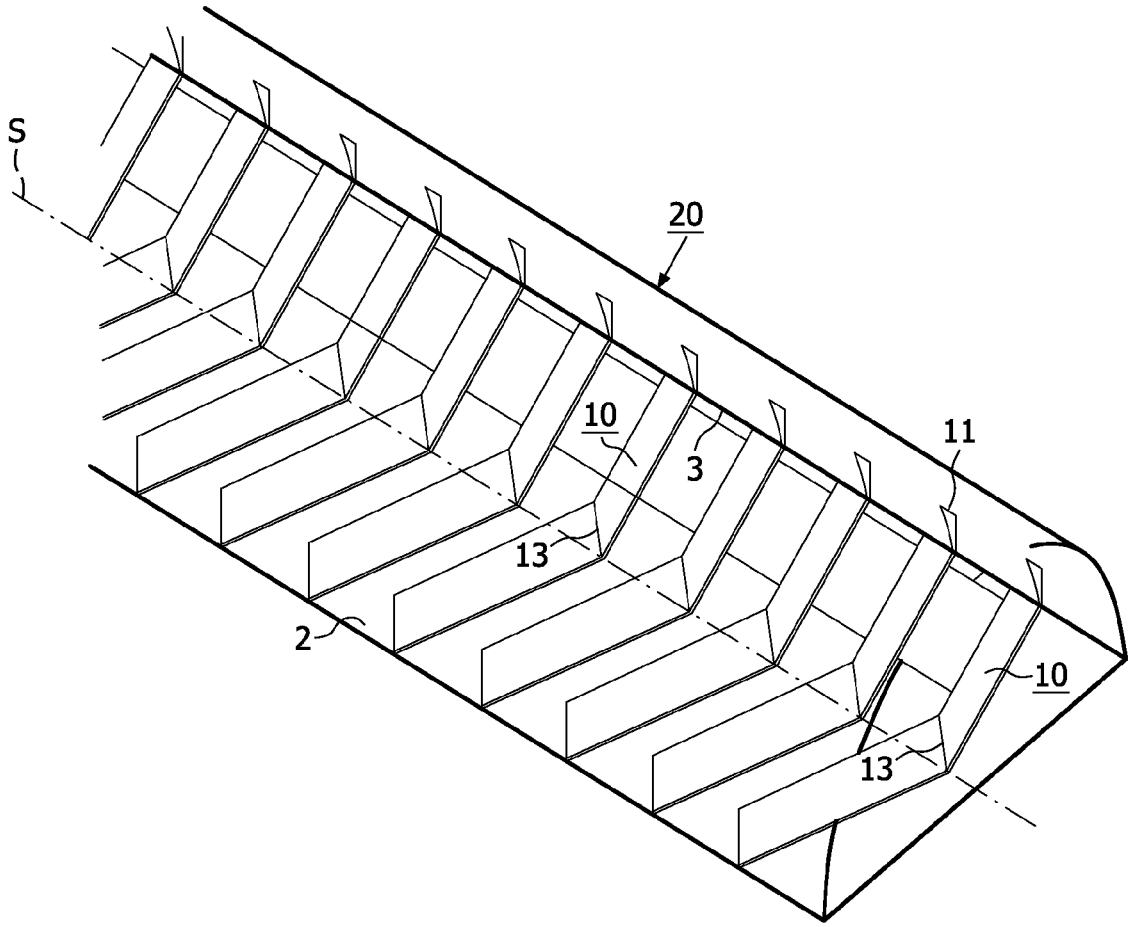
FIG. 4 is a perspective view of a second embodiment of a lamellae louver.
Figure 5:
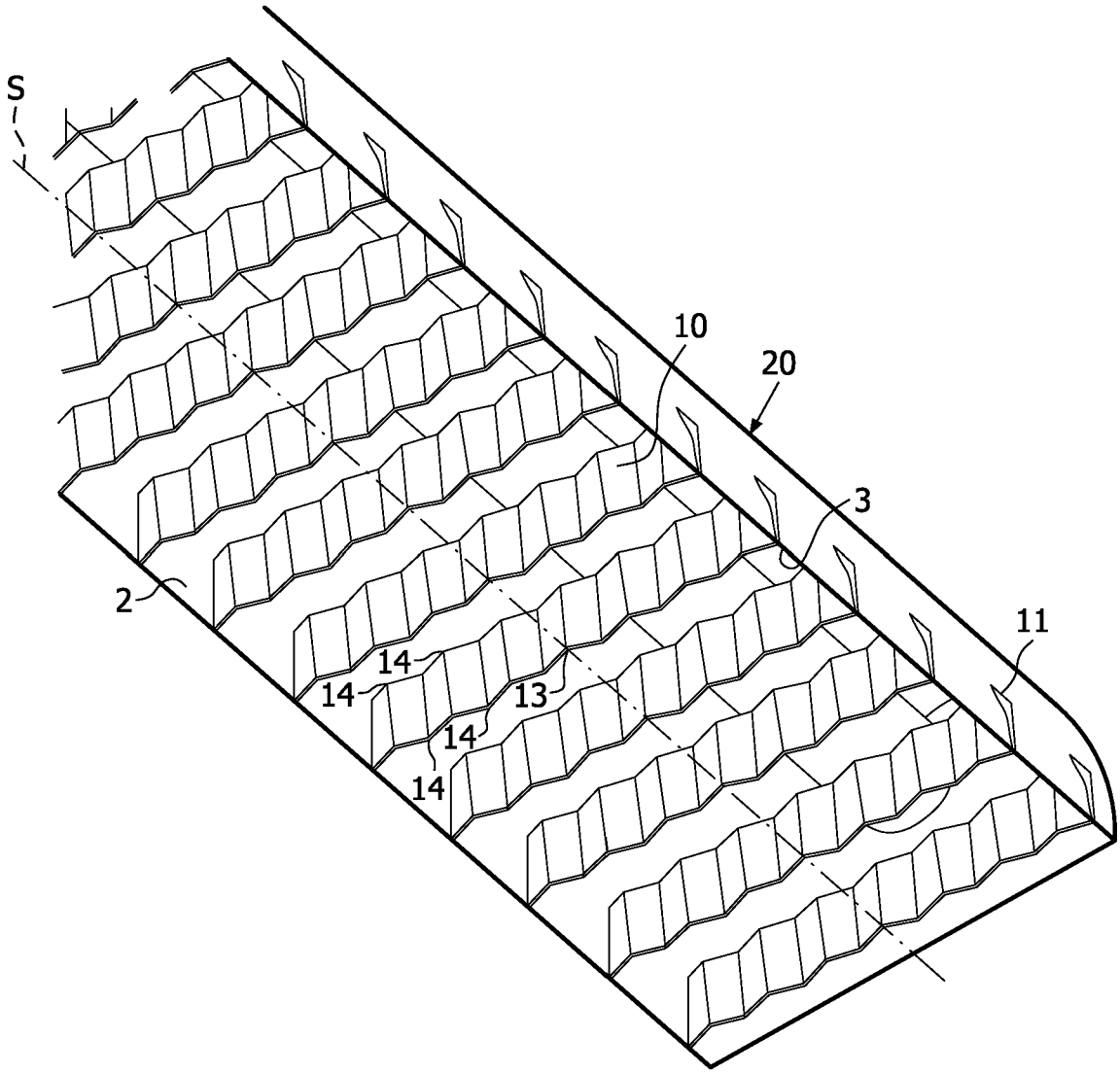
FIG. 5 is a perspective view of a third embodiment of a lamellae louver.

In FIGS. 4 and 5, the lamellae louver 20 is built up from the side reflectors 2 and 3 and the lamellae 10. In FIG. 4 a kink 13 is present in the main plane S. The lamellae extend at each side of plane S at the angle δ thereto, δ being 72° in the Fig. As a result of the presence of the kink 13, the lamellae have a smaller portion parallel to plane S than in FIG. 3.

In FIG. 5 the lamellae 10 of the louver 20 each have at least one additional kink 14 at each side of main plane S.

The number of additional kinks 14 and the distance between neighboring kinks 14 is such that the portion of each lamella 10 that extends parallel to the main plane S corresponds at most to the mutual distance of the lamellae 10.

In the louver 20 shown, the lamellae 10 have 6 additional kinks 14 at either side of the main plane S, which kinks 14 are at equal distances and enclose equal angles. As a result, these lamellae each have 14 equal facets. Although the louver 20 has no plane of symmetry transverse to the main plane S, this is observable only upon accurate observation. The lamellae louver 20 and a luminaire having lamellae 10 as shown in FIG. 5 have the advantage that the UGR norm is complied with, but in addition that no asymmetry seems to be present. Also, the portion of each lamella 10 that extends parallel to the main plane S is rather small. Another advantage is that deviating triangular openings which are present in FIGS. 1, 3 and 4 near the narrow end faces are absent in FIG. 5.

A stronger effect could be achieved with an even larger number of additional kinks, given a luminaire having a light emission window of equal width, and a similar effect with a slightly smaller number. Also, when a similar number of kinks 14 is present, the absence of a kink 13 in the main plane S has no or hardly any optical or visual effect. A luminaire and a lamellae louver of the kind described herein, which have kinks 14 in the lamellae 10 laterally of the main plane S, but are lacking a kink 13 in the main plane, are within the scope of the present invention, too.

Figure 6:
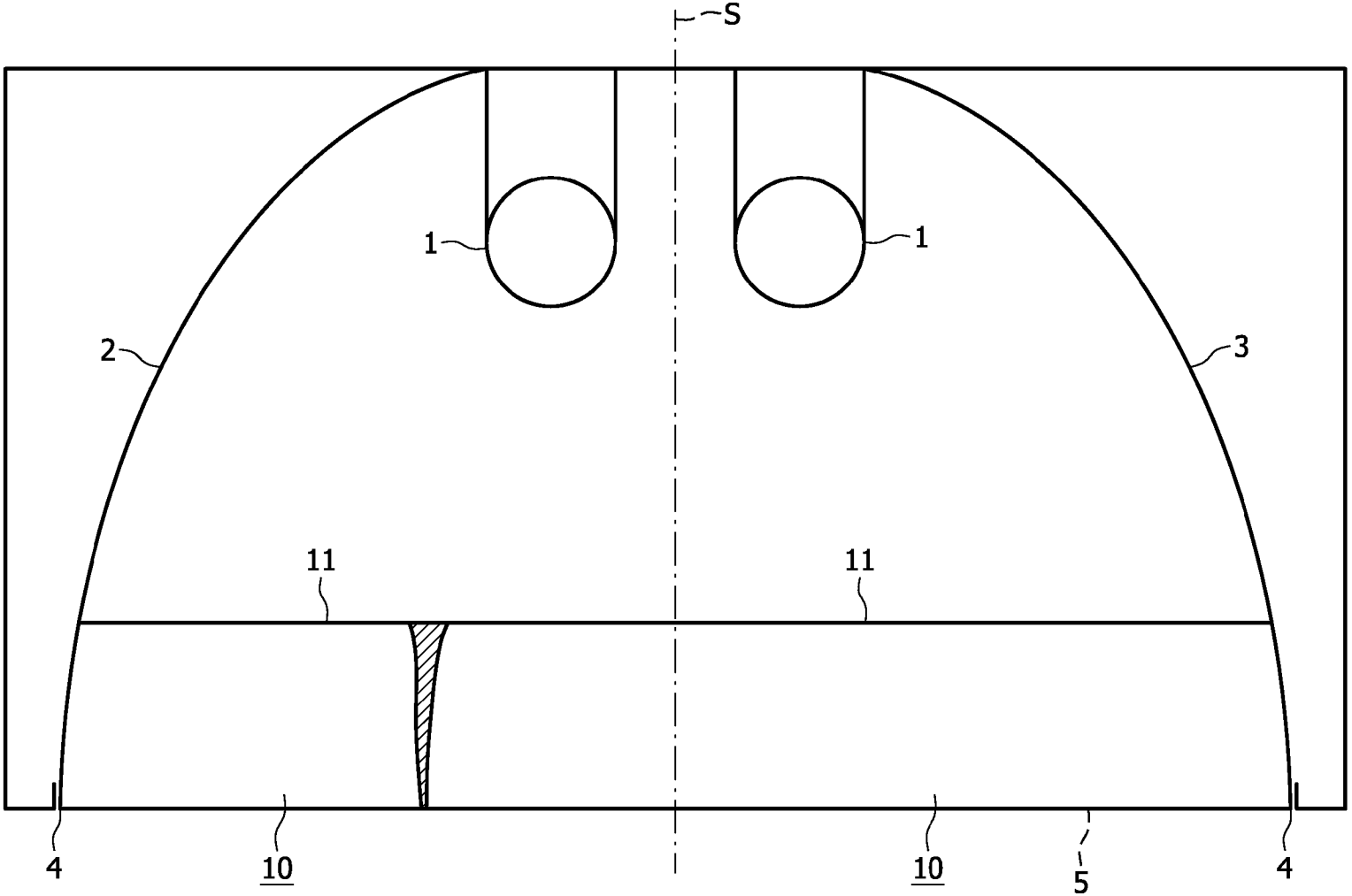
FIG. 6 is a cross-section of another embodiment of the luminaire.

The cross-section of FIG. 6 is similar to the one of FIG. 2. The embodiment shown, however, is suitable for accommodating two elongate lamps, each extending parallel to the main plane S at a respective side of the main plane S.

The invention claimed is:

1. A luminaire comprising:

means for accommodating at least one elongated light source parallel to a main plane;

a respective-side reflector at either side of the main plane, each of said side reflectors having a respective rim;

an elongate light emission window extended between the rims, transverse to the main plane; and a plurality of substantially equidistant lamellae extending from one side reflector to the other wherein each lamella comprises an inner face facing away from the light emission window and side faces extending therefrom so as to meet one another adjacent the light emission window, and wherein each lamella encloses an acute angle with the main plane.

2. The luminaire according to claim 1, characterized in that the acute angle is in the range of 65° to 85°.

3. The luminaire according to claim 2, wherein each of said plurality of substantially equidistant lamella has a kink at and symmetrical to the main plane.

4. The luminaire according to claim 3, wherein each lamellae has at least one additional kink at each side of main plane.

5. The luminaire according to claim 4, wherein a number of additional kinks and a distance between neighboring kinks are such that a portion of each lamella that extends parallel to the main plane corresponds at most to a mutual distance of the lamellae.

6. A lamellae louver comprising:

a frame for accommodating at least one elongated light source parallel to a main plane; and a plurality of substantially equidistant lamellae extending between sides of the frame and intersecting the main plane at acute angle.

7. The lamellae louver according to claim 6, wherein the acute angle is in the range of 65° to 85°.

8. The lamellae louver according to claim 7, wherein each lamella has a kink at and symmetrical to the main plane.

9. The lamellae louver according to claim 8, wherein each lamella has at least one additional kink at each side of the main plane.

10. The lamellae louver according to claim 9, wherein a number of the additional kinks is configured for having a projection of each of said plurality of substantially equidistant lamellae onto said longitudinal main plan generally corresponding to a mutual distance between lamellae within said plurality of substantially equidistant lamellae.

* * * * *